United States Patent [19]

Logan

[11] Patent Number: 4,738,057

[45] Date of Patent: Apr. 19, 1988

[54] ARCH SUPPORTED RETRACTABLE INFLATABLE ROOF

[76] Inventor: Kenneth C. Logan, P.O. Box 48168, Bentall Centre, Vancouver, British Columbia, Canada, V7X 1N8

[21] Appl. No.: 33,216

[22] Filed: Apr. 2, 1987

Related U.S. Application Data

[63] Continuation-in-part of Ser. No. 852,014, Apr. 14, 1986, abandoned.

[51] Int. Cl.[4] ..... E04H 3/10

[52] U.S. Cl. ..... 52/2; 52/6; 52/65; 52/66

[58] Field of Search ..... 52/86, 65, 6, 63, 66

[56] References Cited

U.S. PATENT DOCUMENTS

| | | | |
|---|---|---|---|
| 1,841,321 | 1/1932 | Arnstein | 52/85 |
| 1,861,069 | 5/1932 | Smith | 52/65 |
| 3,195,275 | 7/1965 | Praeger | 52/65 |
| 3,288,158 | 11/1966 | Gugliotta | 52/65 |
| 3,777,425 | 12/1973 | Bourgeois | 52/63 |
| 3,815,299 | 6/1974 | Sörensen | 52/66 |
| 4,175,361 | 11/1974 | Kumode | 52/66 |
| 4,566,475 | 1/1986 | Wand | 52/65 |
| 4,676,033 | 6/1987 | Allen | 52/6 |

FOREIGN PATENT DOCUMENTS

| | | | |
|---|---|---|---|
| 254492 | 12/1912 | Fed. Rep. of Germany | 52/65 |
| 452965 | 11/1927 | Fed. Rep. of Germany | 52/85 |

OTHER PUBLICATIONS

Popular Science, Oct. 1958, p. 131.

*Primary Examiner*—Henry E. Raduazo

[57] ABSTRACT

The present invention relates in general to a roof construction and more particularly to a roof composed of a main spanning arch or arches above or beneath which other arches or arch sections rotate horizontally for the purpose of covering large areas such as stadiums, arenas, or storage and manufacturing areas, which roof can be moved from an open position where the area is exposed to the weather elements to a closed position wherein the area is shielded from the weather elements.

7 Claims, 7 Drawing Sheets

ARCH SUPPORTED RETRACTABLE INFLATABLE ROOF

The present application is a continuation-in-part of application Ser. No. 852,014 which was filed on Apr. 14, 1986 and now abandoned.

The present application represents merely a clarification and more detailed description in support of claims contained in the original application and as such, the applicant requests the benefit of the filing date of the original application.

As an example of the utility of the present invention one may take the case of large sport arenas presently utilized by some of the major baseball league teams to play baseball and some of the major football league teams in the playing of professional football. Provision has been made in some of the prior art to cover some of these stadia with permanent roofs. Most of these stadiums with permanent roofs comprise a vertically extending wall structure on top of which the perimeter of the permanent roof rests. Such roofs are generally dome shaped with the materials of construction being in some cases reinforced concrete, in some cases a steel truss work covered with steel or other lighter weight material (e.g. plexiglas) and in more recent cases some fixed roofs have been made of fabric supported by a cable network with the entire enclosed stadium slightly pressurized causing the fabric roof to billow up into a generally domed shape.

The prior art has also provided for retractable roofs by the use of folding fabric to effect field exposure. Such retraction systems involve vast areas of fabric and the wear on the fabric with repeated bending and passage across hardware items tends to reduce the potential lifespan of the roof.

The prior art also utilizes in some instances essentially fixed structures with limited areas retractable to produce the effect of a partially uncovered facility.

The present invention seeks to obviate the disadvantages in any of the hereinabove described prior art structures by providing a retractable roof that does not require folding and that provides extensive interior exposure.

Another object of the present invention is to provide a cover construction whereby the roof may be partially comprised of fabric sections that may retract without requiring folding or other abrasive treatment.

Another object of the present invention is to provide a roof closure construction whereby the closure mechanisim utilized includes a wheel and track system for effecting the movement of the cover sections between open and closed positions.

Other objects and a fuller understanding of this invention may be had by referring to the following description and claims, taken in conjunction with the accompanying drawings in which:

Figure 1:
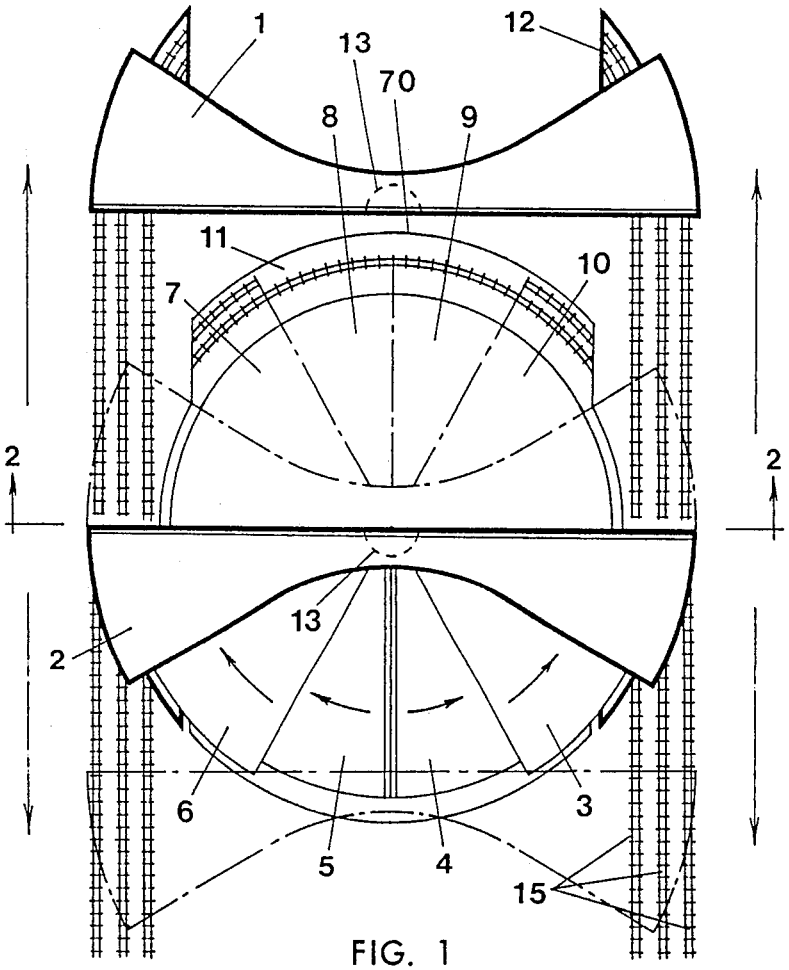
FIG. 1 is a plan view showing one half of the roof fully retracted, the other half fully closed.

Referring to the drawings, and to FIG. 1 in particular, a retractable roof system is shown in plan view. Main arch 1 with arch sections 7,8,9 and 10 rotated in beneath it is shown laterally rolled away from the stadium 70. Main arch 2 with arch sections 3,4,5 and 6 are shown in the fully closed configuration. Arch sections 3,4,5 and 6 may be rotated in beneath main arch 2 and the entire system rolled away laterally thus effecting complete exposure of the stadium interior.

Figure 2:
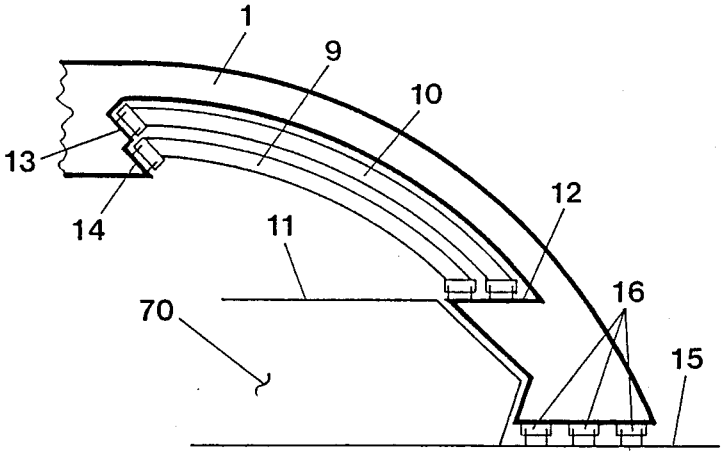
FIG. 2 is an elevation depicting one side of one of the main arches with arch sections in the retracted configuration.

Referring to both FIGS. 1 and 2, the moveable curved track bed 12 is shown. This track bed is integral with and is fully supported by the main arches 1 and 2. The upper ends of all arch sections rotate on apex track beds 13 and 14 which are in turn fully supported by main arches 1 or 2. The moveable track bed 12 may roll laterally without interfering with the stationary curved track bed 11. The bases of main arches 1 and 2 rest upon standard railway undercarriage trucks 16 which roll laterally on a grade level track bed 15.

Figure 3:
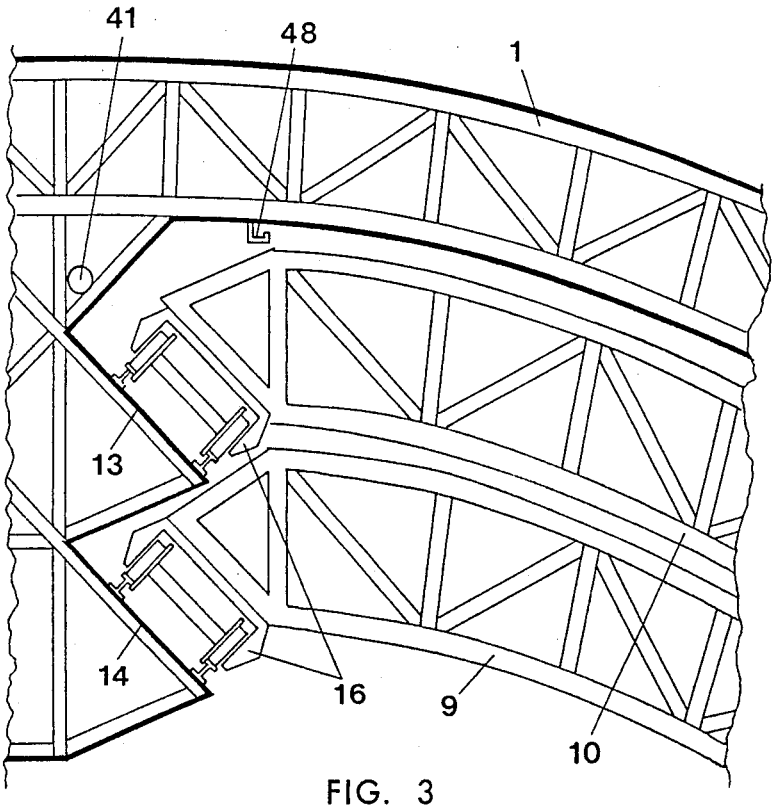
FIG. 3 is an enlarged elevation showing one side of one of the main arches near the apex.
Figure 4:
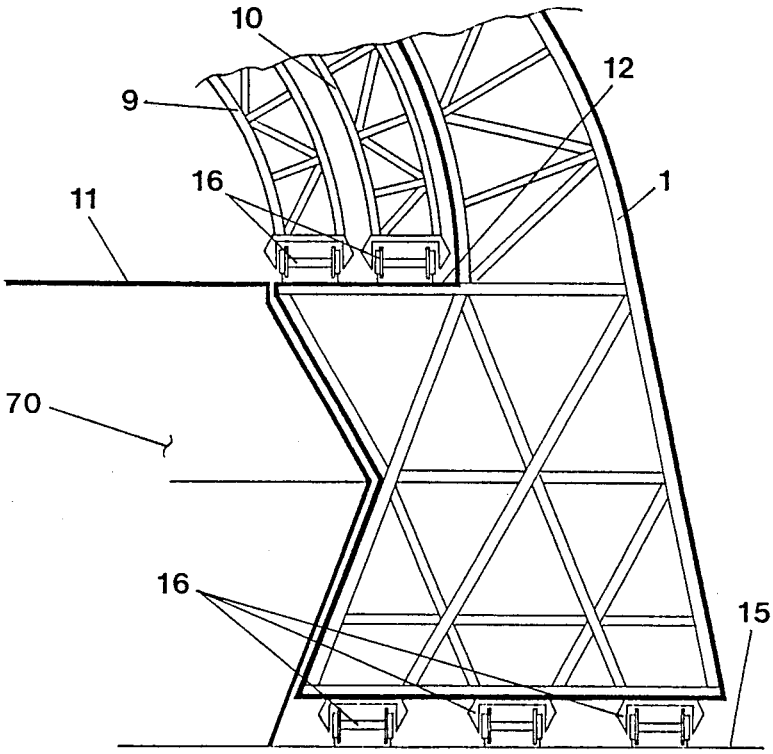
FIG. 4 is an enlarged elevation showing one side of one of the main arches near the base.

FIGS. 3 and 4 show expanded views of the apex track area and the arch section and main arch bases. In all cases, the rotating ends are supported by standard railway undercarriage trucks 16.

Figure 5:
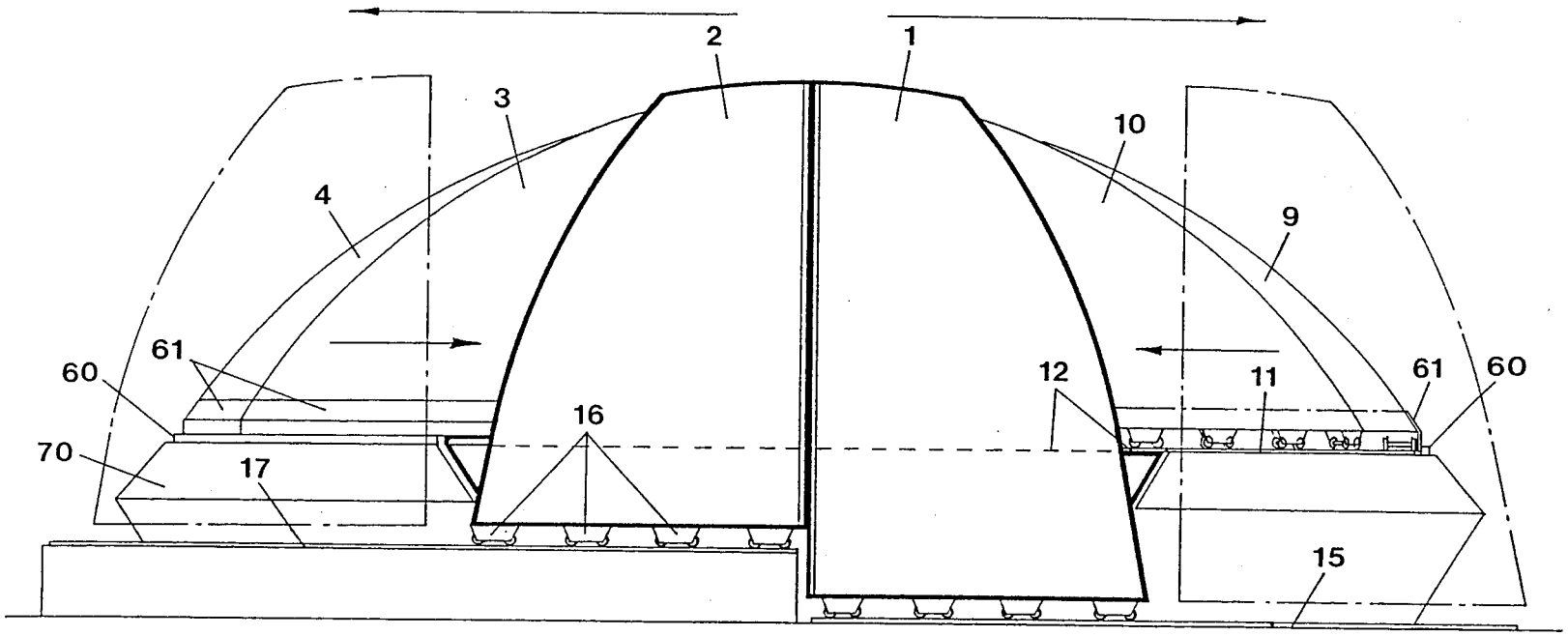
FIG. 5 is an overall side elevation.

FIG. 5 is a side elevation. In this depiction, main arch 2 is shown rolling on an elevated track bed 17. This elevated track bed may in some cases be at the same elevation as the moveable track bed 12 and the stationary curved track bed 11.

Figure 6:
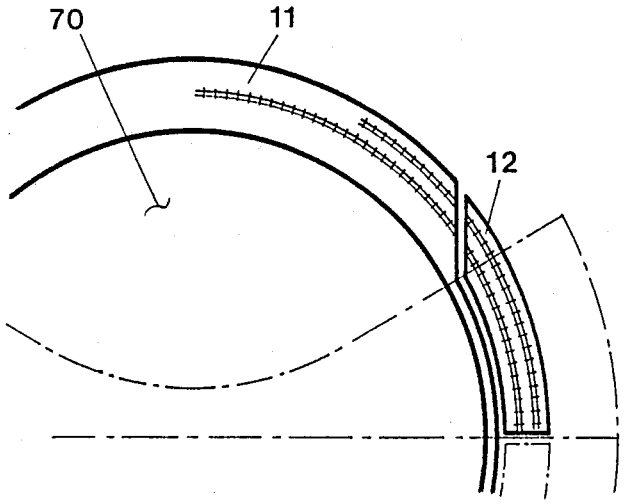
FIG. 6 is a plan view showing both stationary and moveable arch section base track beds.

FIG. 6 provides a clear plan view of one quadrant of the curved track bed showing that moveable track bed 12 is able to roll away laterally without interfering with the stationary track bed 11. Actual clearances between track beds 11 and 12 are critical and are to be designed to allow for rail expansion.

Figure 7:
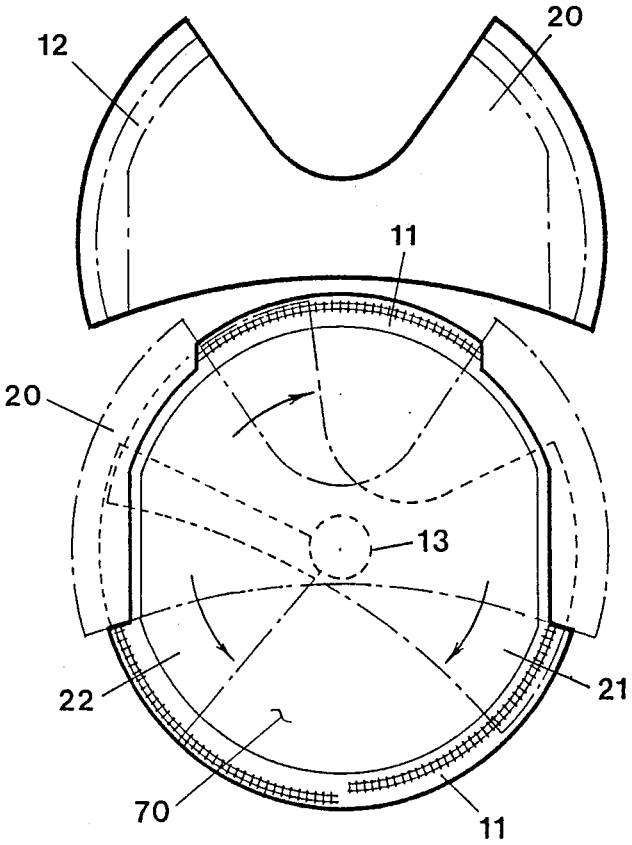
FIG. 7 is a plan view depicting non-symmetrical arches.

FIG. 7 represents a generalized definition for arch and arch section shapes. It is to be understood that non-symmetrical shapes are within the scope of the present invention. FIG. 7 also illustrates a configuration wherein the roof has only one main arch 20 with lateral movement in one direction only effecting complete interior exposure. FIG. 7 shows a rotating arch 21 however, this could be comprised of two rotating arch sections similar to non-opposed arch section 22. There is an infinite number of arch and arch section shapes that may be used to effect a retractable roof system.

Figure 8:
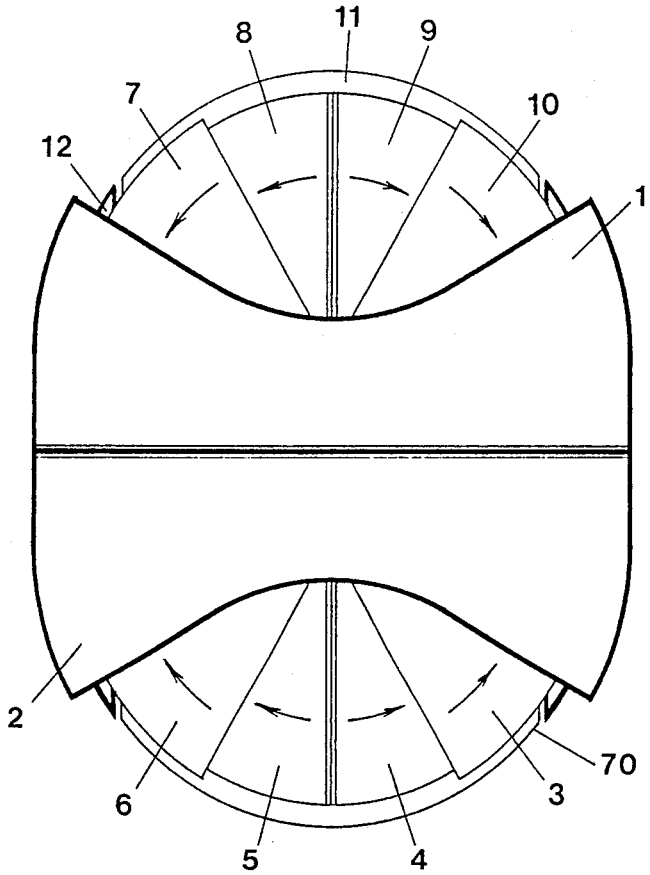
FIG. 8 is a plan view depicting an oblong configuration.

FIG. 8 is a special configuration wherein the stadium to be covered is non-circular but has circular ends whereon arch sections may roll on a curved track bed 11 onto a moveable curved track bed 12 thus permitting main arches 1 and 2 to roll away laterally similar to the movement described in FIG. 1.

Figure 9:
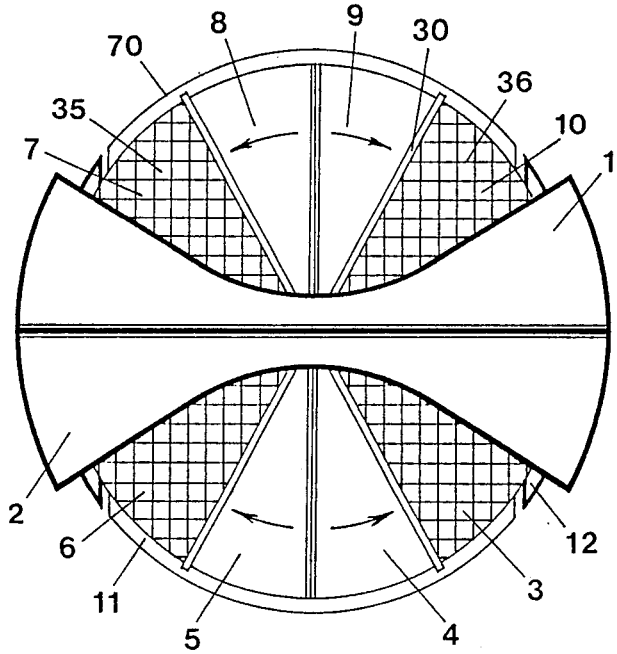
FIG. 9 is a plan view depicting a configuration comprised of some fabric sections.

FIG. 9 is a special configuration wherein arch sections 3, 6, 7 and 10 are comprised of fabric 35 suspended on a cable network 36. This configuration has the same capability for retraction and roll-away as that described in FIG. 1.

Referring to FIGS. 10, 11, 12 and 13 the fabric sections are deployed and retracted as follows: When fully retracted, the fabric section 3 rests atop rigid arch section 4 and both sections 3 and 4 are parked directly beneath one side of main arch 2. (For this description, only one quadrant will be decribed however it is understood that the process applies to all quadrants). To commence roof closure, arch section 4 carrying fabric section 3 rotates clockwise through approximately 30 degrees at which point the trailer seal bracket 44 which is mounted on the fabric trailer 42 which in turn rests upon the trailer support bracket 49 comes in contact with the main arch seal bracket 46. The fabric trailer 42 is then held stationary by suitable means. A remote air compressor is activated introducing compressed air into a circular header 41 located near the apex track bed 13 (see FIG. 4). This conveys compressed air into the rotating arch section air duct 38 and the fabric dolly air duct 32 using flexible hoses 39. The effect of this is to produce an air cushion beneath the fabric section allowing it to float free of the rigid arch section 4.

Arch section 4 continues to rotate clockwise however, the fabric section which is afixed to the now stationary fabric trailer 42 by clips 43 also remains stationary as the rigid arch section 4 rotates out from beneath it. As the rigid arch section 4 rotates, the fabric dolly 30 rolls on a dolly track 37 with the fabric attached with clips 34 and sealed with a gasket material 33. Arch section 4 completes clockwise rotation and the quadrant is fully closed. This process is performed simultaneously for all four quadrants. Once closed, the air supply to the apex header 41 may be shut off.

To retract the quadrant, the fabric dolly 30 is locked in place on the stationary track bed 11. The air compressor is re-activated and as the rigid arch section 4 begins to rotate counter-clockwise beneath the fabric section 3, the compressed air egressing from the rotating arch section air duct 38 and the fabric dolly air duct 32 provides a cushion between the rigid arch and the fabric section thus reducing wear on the fabric. The rigid arch section 4 continues to rotate counter-clockwise until the trailer support bracket 49 slides beneath the fabric trailer 42. The fabric dolly 30 and the fabric trailer 42 are released permitting rotary movement and the air supply is shut off. The fabric section 3 settles onto the surface of the rigid section 4. The rigid section 4 continues counter-clockwise rotation carrying the fabric section 3 atop until both sections come to rest beneath one side of the main arch 2. The quadrant is now retracted. The process is performed simultaneously for all four quadrants.

Figure 10:
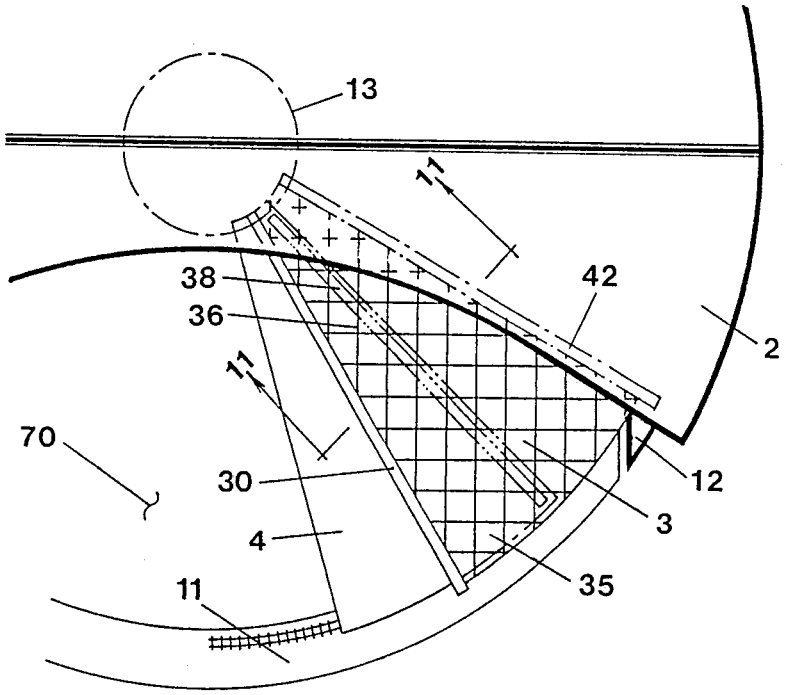
FIG. 10 is a plan view of one quadrant of the fabric section configuration.
Figure 11:
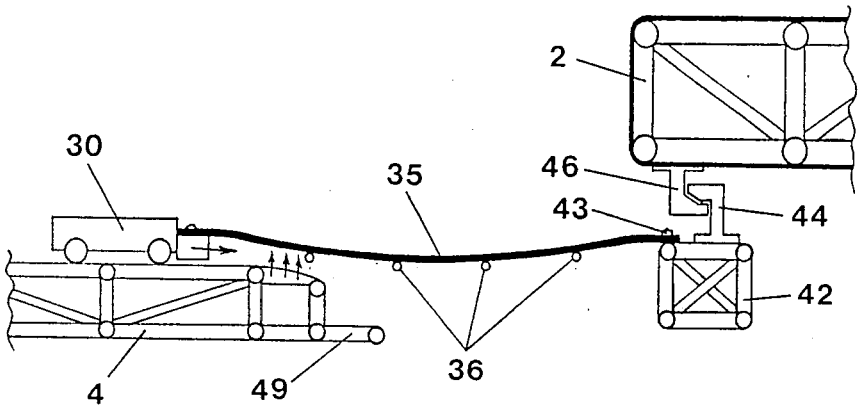
FIG. 11 is a sectional elevation showing the fabric conveyance scheme.

Regarding sealing, although only the air tight sealing of the special fabric configuration shown in FIG. 9 is detailed hereinafter, similar techniques are used for the weather tight sealing of other configurations. In the following description, the main arch 2 and arch section 4 as shown in FIG. 10 are used for illustration however, the description applies to the other three quadrants of the roof as well. For this description, it is assumed that the upper surfaces of main arch 2 and arch section 4 are covered with an appropriate material (steel cladding, plexiglass etc.). Also, the edge or vertical surfaces of the main arch 2 are similarly covered.

Regarding the seal between the underside of the main arch 2 and the top side of the fabric trailer 42, the main arch seal bracket 46 and the trailer seal bracket 44 are designed so that when they engage, an effective air seal is created.

Regarding the seal along the base perimeter of both the arch section 4 and the fabric section 3 (see FIG. 10) a fabric shroud 61 (see FIG. 5) is afixed along the base of arch section 4. When the roof is in the closed position, and is under compression, the lower end of this shroud 61 together with the lower end of the fabric section 3 (see FIG. 9) press out against a sealing curb 60 (see FIG. 5) which extends vertically from curved track beds 11 and 12.

Figure 12:
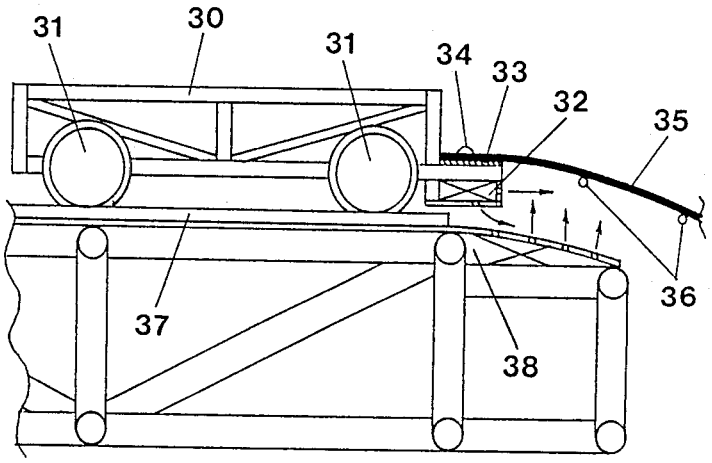
FIG. 12 is a detail of the fabric dolly.
Figure 13:
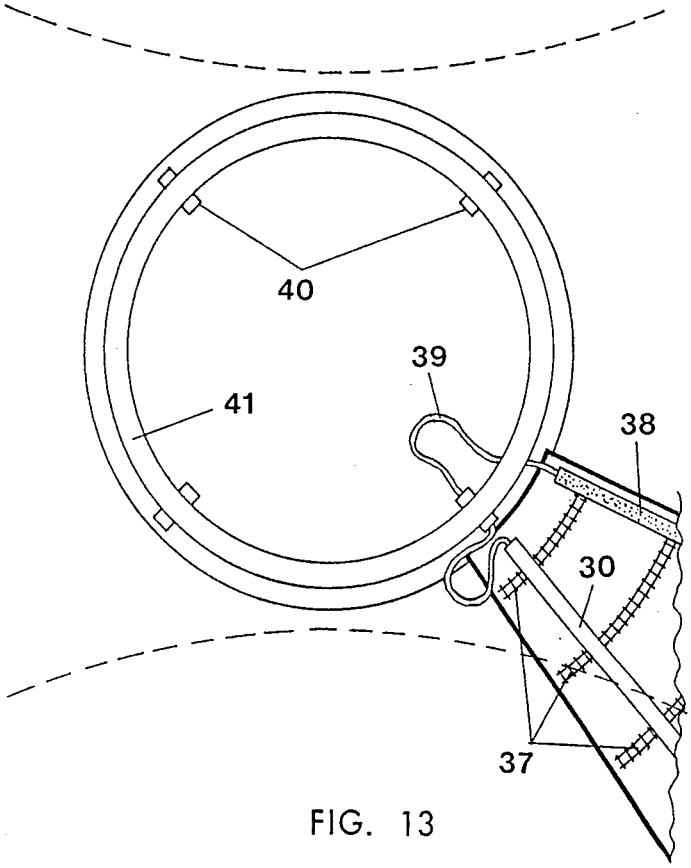
FIG. 13 is a detail of the air delivery system.

Regarding the seal between the underside of fabric section 3 and the outer side of arch section 4, refer to FIG. 12. In the fully closed position, the air supply system described in FIG. 13 would continue to supply air to the fabric dolly air duct 32 and the rotating arch section air duct 38 however, at a small fraction of the pressure required during the opening and closing processes. This continuous airflow from the fabric dolly air duct 32 and the rotating arch section air duct 38 produce an "air cushion" that provides an effective air tight seal between the underside of the fabric section 3 and the outer side of the arch section 4.

Regarding the seal at the top or apex area of the fabric section 3, refer to FIG. 3. A slotted fabric track 48 is attached to the underside of the main arch 2 (the view shown in FIG. 3 shows main arch 1 however the slotted fabric track 48 is also attached in a similar location on main arch 2). This track 48 extends along the path of the upper or apex edge of fabric section 3 throughout both its' open and closed traverses. The upper edge of fabric section 3 contains grommets (not shown) at frequent intervals to which roller devices (not shown) similar to those used in the suspension of household window drapes (but larger) are attached and which roll in the slotted fabric track 48. The track 48 is of such a design as to provide a virtually complete seal.

With the roof sealed and assuming the sub-structure has been designed for air tight sealing, the structure may be pressurized by a remote air compressor causing the fabric sections 3, 6, 7 and 10 (see FIG. 9) to billow up into a generally domed shape.

Although illustrative embodiments of the present invention have been described herein with reference to the accompanying drawings, it is to be understood that the invention is not limited to these precise embodiments, and that various changes and modifications may be effected therein by one skilled in the art without departing from the scope of spirit of this invention.

The embodiments of the invention in which an exclusive property or privilege is claimed are defined as follows:

1. A roof system for covering stadium areas and the like comprising at least one main arch having an apex and lower base legs spanning said open area, a substantially circular apex track supported at the apex of the main arch and a substantially circular base track system part of which is supported by the main arch adjacent said base legs, a series of one or more arch sections each having an apex portion supported by said apex track and base portion supported by said circular base track system and being movable from closed configuration where the main arch and arch sections close a substantial portion of the stadium area to an aligned-open configuration where the arch sections are supported by the main arch, and a second base track system supporting the lower base legs of said at least one main arch where by the main arch and said supported arch sections may be rolled laterally to open the stadium area.

2. The roof system of claim 1 wherein there are two main arches each supporting one or more arch sections and each movable to open the stadium area.

3. The roof structure of claim 2 wherein the two main arches are movable in opposite directions on the second base track system to effect retraction of the roof from the stadium area.

4. The roof system of claim 1 where in one or more of the arch sections are comprised of fabric.

5. The roof structure as defined in claim 4 wherein the fabric roof sections are supported by air pressure when in a closed configuration over the stadium area.

6. A roof structure as defined in claim 1 wherein the stadium area is non-circular.

7. A roof structure as defined in claim 6 wherein the stadium area is oblong.

* * * * *